US006848511B1

(12) United States Patent
Jones et al.

(10) Patent No.: US 6,848,511 B1
(45) Date of Patent: Feb. 1, 2005

(54) PLUG AND BALL SEAT ASSEMBLY

(75) Inventors: Frank Jones, Broussard, LA (US); Elmer F. Wooley, Youngsville, LA (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 10/314,490

(22) Filed: Dec. 6, 2002

(51) Int. Cl.[7] ..... E21B 23/08; E21B 33/13

(52) U.S. Cl. ..... 166/386; 166/192; 166/153; 166/285

(58) Field of Search ..... 166/382, 285, 166/192, 193, 153, 155, 386, 291

(56) References Cited

U.S. PATENT DOCUMENTS

| | | | | | |
|---|---|---|---|---|---|
| 3,159,219 | A | * | 12/1964 | Scott | 166/156 |
| 3,256,937 | A | | 6/1966 | Haeber et al. | |
| 4,047,566 | A | * | 9/1977 | Duke | 166/285 |
| 4,096,913 | A | * | 6/1978 | Kenneday et al. | 166/290 |
| 4,292,988 | A | | 10/1981 | Montgomery | |
| 4,809,776 | A | * | 3/1989 | Bradley | 166/153 |
| 4,862,966 | A | * | 9/1989 | Lindsey et al. | 166/382 |
| 5,413,172 | A | * | 5/1995 | Laurel | 166/153 |
| 5,522,458 | A | * | 6/1996 | Watson et al. | 166/202 |
| 5,722,491 | A | * | 3/1998 | Sullaway et al. | 166/291 |
| 5,829,523 | A | * | 11/1998 | North | 166/250.14 |
| 6,079,496 | A | | 6/2000 | Hirth | 166/321 |
| 6,244,350 | B1 | | 6/2001 | Gudmestad et al. | 166/386 |
| 6,311,775 | B1 | | 11/2001 | Allamon et al. | |
| 6,318,472 | B1 | | 11/2001 | Rogers et al. | 166/382 |
| 6,491,103 | B2 | * | 12/2002 | Allamon et al. | 166/318 |
| 2002/0144813 | A1 | | 10/2002 | Allamon et al. | |

OTHER PUBLICATIONS

U.K. Search Report, Application No. GB 0327739.9, dated Mar. 1, 2004.

* cited by examiner

*Primary Examiner*—David Bagnell
*Assistant Examiner*—T Shane Bomar
(74) *Attorney, Agent, or Firm*—Moser, Patterson & Sheridan, L.L.P.

(57) ABSTRACT

Aspects of the present invention provide apparatus and methods of releasing a plug. In one aspect, a plug and ball seat assembly for releasing a plug is disclosed. The assembly is selectively maintained in a housing using a mounting system. The plug and ball seat assembly includes a ball seat selectively connected to the plug. The mounting system is designed such that disengaging the ball seat from the plug also disengages the plug from the housing, thereby releasing the plug. In another aspect, a method of releasing a plug includes selectively connecting a ball seat to the plug and disposing the plug and ball seat assembly within a tubular. When the plug is ready for release, the ball seat is disconnected from the plug and allowed to move axially relative to the plug. In turn, the plug and ball seat assembly disconnects from the tubular and releases downhole.

20 Claims, 6 Drawing Sheets

PLUG AND BALL SEAT ASSEMBLY

BACKGROUND OF THE INVENTION

1. Field of the Invention

The present invention generally relates to fluid circulation operations for a wellbore. More particularly, the invention relates to a plug and ball seat assembly for releasing a wiper plug during cementing operations.

2. Description of the Related Art

In the drilling of oil and gas wells, a wellbore is formed using a drill bit that is urged downwardly at a lower end of a drill string. After drilling a predetermined depth, the drill string and bit are removed and the wellbore is lined with a string of casing. An annular area is thus formed between the string of casing and the formation. A cementing operation is then conducted in order to fill the annular area with cement. The combination of cement and casing strengthens the wellbore and facilitates the isolation of certain areas of the formation behind the casing for the production of hydrocarbons.

It is common to employ more than one string of casing in a wellbore. In this respect, a first string of casing is set in the wellbore when the well is drilled to a first designated depth. The first string of casing is hung from the surface, and then cement is circulated into the annulus behind the casing. The well is then drilled to a second designated depth, and a second string of casing, or liner, is run into the well. The second string is set at a depth such that the upper portion of the second string of casing overlaps the lower portion of the first string of casing. The second "liner" string is then fixed or "hung" off of the surface casing. Afterwards, the liner is also cemented. This process is typically repeated with additional liner strings until the well has been drilled to total depth. In this manner, wells are typically formed with two or more strings of casing of an ever-decreasing diameter.

In the process of forming a wellbore, it is sometimes desirable to utilize various plugs. Plugs typically define an elongated elastomeric body used to separate fluids pumped into a wellbore.

Plugs are commonly used, for example, during the cementing operations for a liner. During a cementing operation for a liner, the liner is typically run into the wellbore at the end of a run-in string. The run-in string usually comprises a string of drill pipe. At the same time, a liner wiper plug is run into the wellbore at the lower end of the drill pipe. The run-in string places the liner and the wiper plug at the desired depth in the wellbore. After a wiper plug is released, it is pumped downhole in order to clean or "wipe" the inside of the liner of mud and debris. In this respect, the liner wiper plug employs radial wipers to contact and wipe mud from the liner as the plug travels downhole.

The process of releasing a liner wiper plug downhole is typically accomplished by pumping a drill-pipe dart down the drill string. The dart is pumped downward by injecting cement or other desired circulating fluid into the wellbore under pressure. The fluid forces the drill pipe dart downward into the wellbore until it contacts a seat in the wiper plug at or near the base of the drill pipe. The dart sealingly lands into the wiper plug. Hydraulic pressure from the injected fluid ultimately causes a releasable connection between the wiper plug and the drill pipe to release, thereby allowing the dart and the wiper plug to be pumped downhole as a single plug. This consolidated wiper plug separates the fluid above the plug, such as cement, from the drilling mud or other circulating fluid below the plug.

As noted, wiper plugs are retained through a releasable connection. A variety of mechanisms have been employed to retain and subsequently release liner plugs. These include mechanisms such as shear screws, dogs, collets, and retaining rings. Many of these utilize a sliding sleeve that is held in place by a shearable device. When the drill-pipe dart lands in the sliding sleeve, the shearable device is sheared and the sleeve moves down, allowing the plug to release.

Certain disadvantages exist with the use of the above release mechanism arrangements. For example, during well completion operations, the release mechanism, such as the shear screws or the sliding sleeve, is subjected to various stresses which may cause premature release of the wiper plug. In some situations the sliding sleeve is subjected to an impact load by a ball or other device as it passes through the inside of the plug. In other situations, a pressure wave may impact the releasable connection. In either of these situations, it is possible for the sliding sleeve or other release mechanism to shear and to thereby inadvertently or prematurely release the wiper plug.

There is a need, therefore, for a more effective release mechanism for a wiper plug. There is a further need for a releasing mechanism for a liner wiper plug which will not prematurely release the plug in the event of a pressure surge. Still further, there is a need for a liner wiper plug releasing mechanism which does not rely upon a sliding sleeve.

SUMMARY OF THE INVENTION

Aspects of the present invention provide apparatus and methods of releasing a plug. In one aspect, a plug and ball seat assembly for releasing a plug is disclosed. The plug and ball seat assembly includes a ball seat selectively connected to the plug. The assembly is selectively maintained in a housing using a mounting system. The mounting system is designed such that disengaging the ball seat from the plug also disengages the plug from the housing, thereby releasing the plug.

In another aspect, a method of releasing a plug includes selectively connecting a ball seat to the plug and disposing the plug and ball seat assembly within a tubular. When the plug is ready for release, the ball seat is disconnected from the plug and allowed to move axially relative to the plug. In turn, the plug and ball seat assembly disconnects from the tubular and releases downhole.

In another aspect still, a method of circulating a fluid within a wellbore includes positioning a plug and ball seat assembly in a path of the fluid. Thereafter, the fluid path is selectively blocked to prevent movement of the fluid through the path. The plug and ball seat assembly is then released into the path of the fluid, thereby allowing the movement of the fluid to continue.

BRIEF DESCRIPTION OF THE DRAWINGS

So that the manner in which the above recited features of the present invention are attained and can be understood in detail, a more particular description of the invention, briefly summarized above, may be had by reference to the embodiments thereof which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1A:
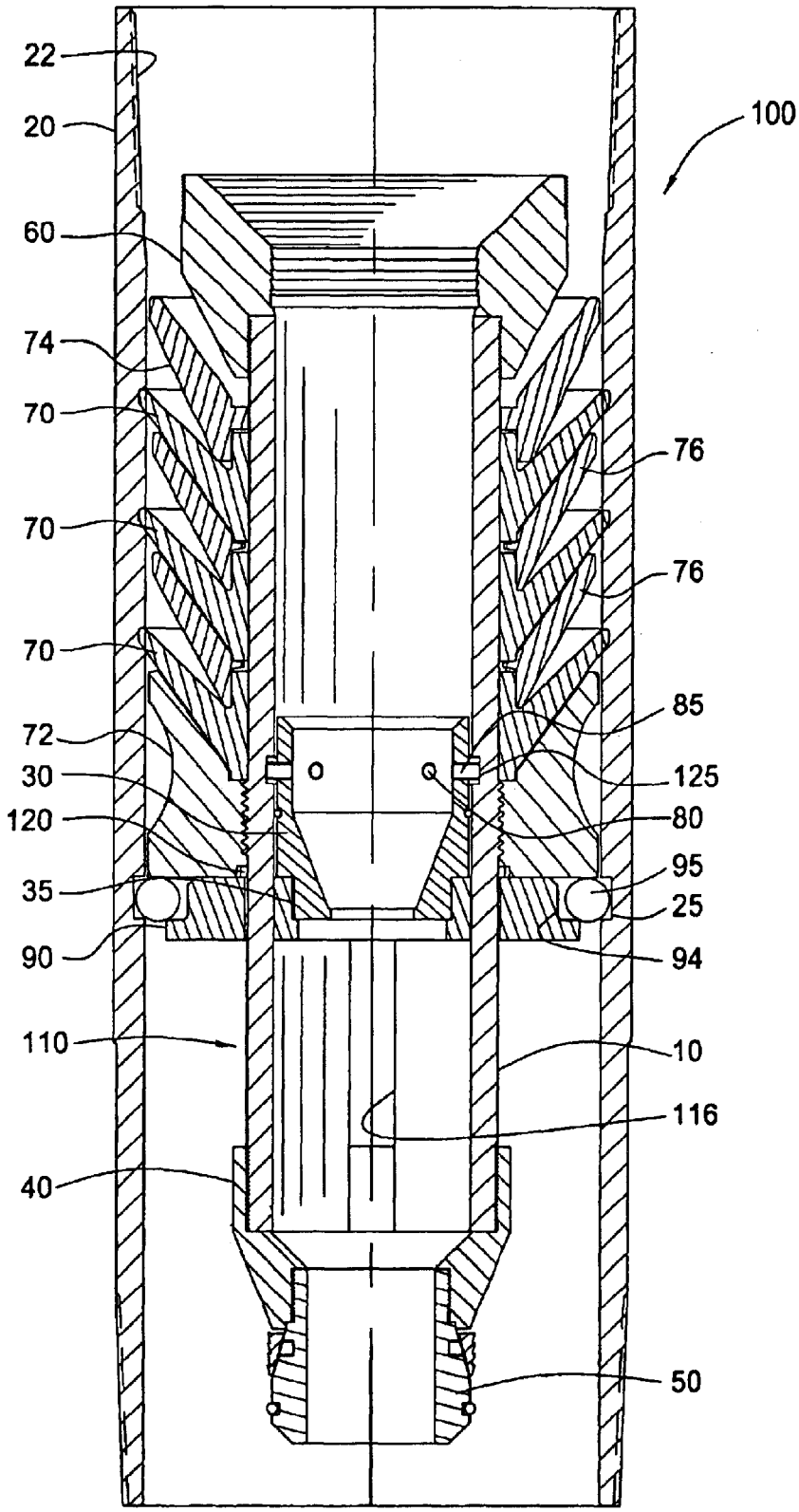
FIG. 1A is a cross-sectional view of a plug and ball seat assembly according to aspects of the present invention. The plug and ball seat assembly is connected to a housing.
Figure 5A:
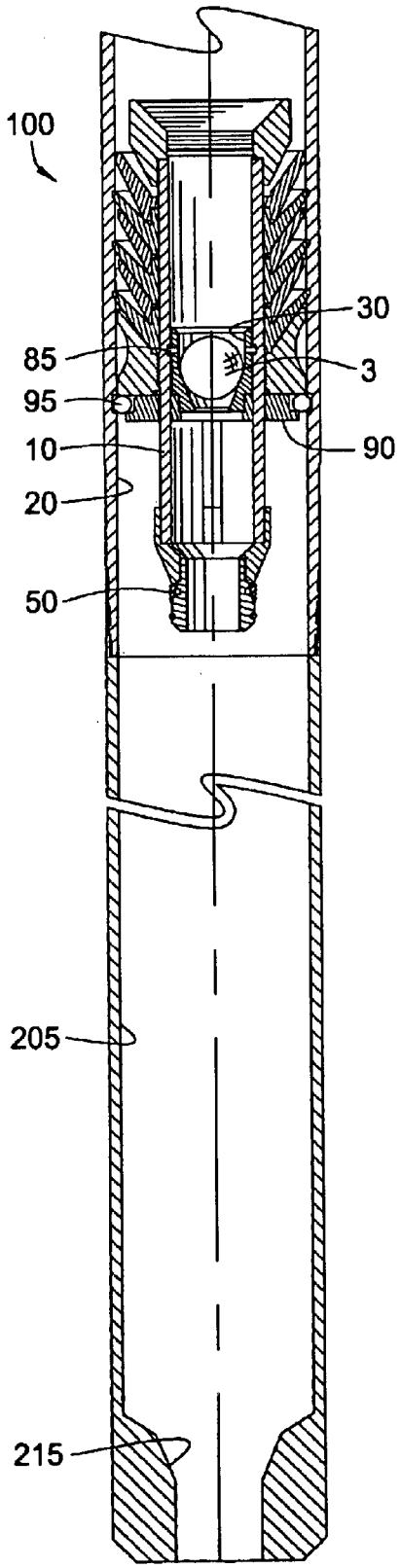
FIG. 5A is a schematic cross-sectional view of the plug and ball seat assembly disposed in a wellbore just after a ball has landed in the ball seat.

FIG. 1A is a cross-sectional view of a plug and ball seat assembly 100 according to aspects of the present invention. The plug and ball seat assembly 100 is designed to be independent of any running tools. The assembly 100 includes a mechanism for releasing the plug 10 downhole. Such an assembly 100 may have many applications, including the release of a liner wiper plug from an upper portion of a liner 205 during a liner cementing operation as shown in FIG. 5A.

As shown in FIG. 1A, the plug and ball seat assembly 100 is disposed in a housing 20. The housing 20 defines a tubular having connection means 22 for connecting to another tubular such as a liner. As shown, threads 22 are formed at the ends of the housing 20 for connecting to another tubular. The connection means 22 facilitate the attachment of the plug and ball seat assembly 100 to the liner or attachment of additional plug and ball seat assemblies. A groove 25 is formed on an inner surface of the housing 20 for maintaining the assembly 100 in the housing 20 before it is ready for release, as will be discussed in more detailed below. Although the housing 20 is shown as a separate tubular, it must be noted that the aspects of the present invention also contemplates disposing the assembly 100 directly in any tubular in which a plug 10 is to be released. For example, the assembly 100 may be disposed directly in the liner by forming the groove 25 in the liner itself. In which case, the liner also functions as the housing 20 for the assembly 100.

Figure 2:
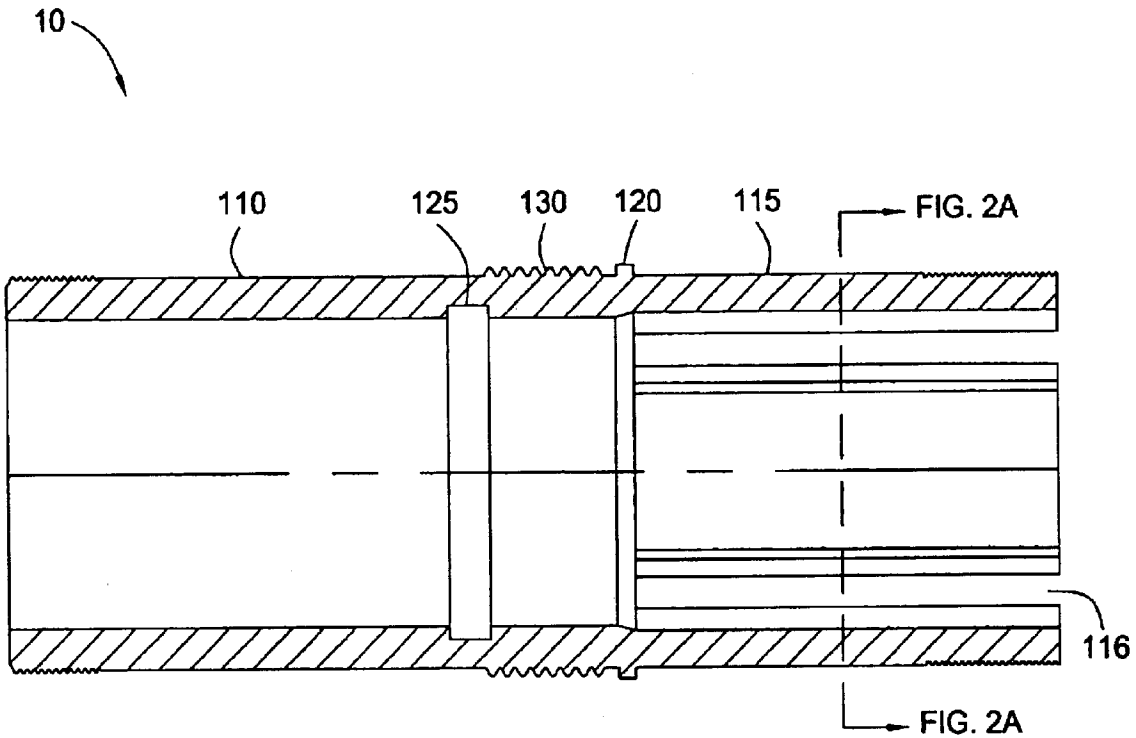
FIG. 2 is a view of the body of the plug in the assembly.
Figure 2A:
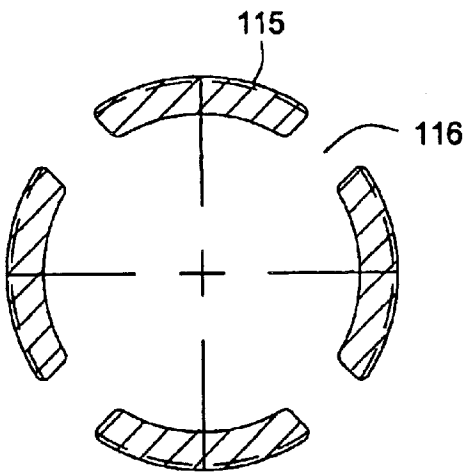
FIG. 2A is a cross-sectional view of the body of the plug of FIG. 2 along line 2A—2A.

The plug and ball seat assembly 100 includes a plug 10 and a ball seat 30 disposed therein. In one embodiment, the plug 10 includes a tubular body 110 having a slotted lower portion 115 as illustrated in FIGS. 2 and 2A. FIG. 2A shows a cross-sectional view of the body taken along line 2A—2A. Preferably, the slotted lower portion 115 is formed by providing a plurality of longitudinal slots 116 on the body 110. The body 110 further includes a stop member 120 to separate the slotted portion 115 from the remaining portions of the body 110. Referring back to FIG. 1A, a nose adapter 40 connects a nose plug 50 to the body 110. Preferably, the nose adapter 40 is threaded onto the end of the slotted portion 115, thereby maintaining the spatial relationship of the slots 116 of the slotted portion 115. A plug landing bushing 60 is installed on an upper end of the body 110 for mating with the nose plug of a successive plug (not shown) dropped into the wellbore during circulation operations.

The plug 10 may be equipped with a plurality of fins 70. The fins 70 allow the plug 10 to wipe or clean an inner surface of the housing 20 and/or the liner 205 as the plug 10 travels along the liner 205. Preferably, the fins 70 are made of an elastomeric material. However, other types of fins 70 are equally applicable as is known to a person of ordinary skill in the art.

Figure 3:
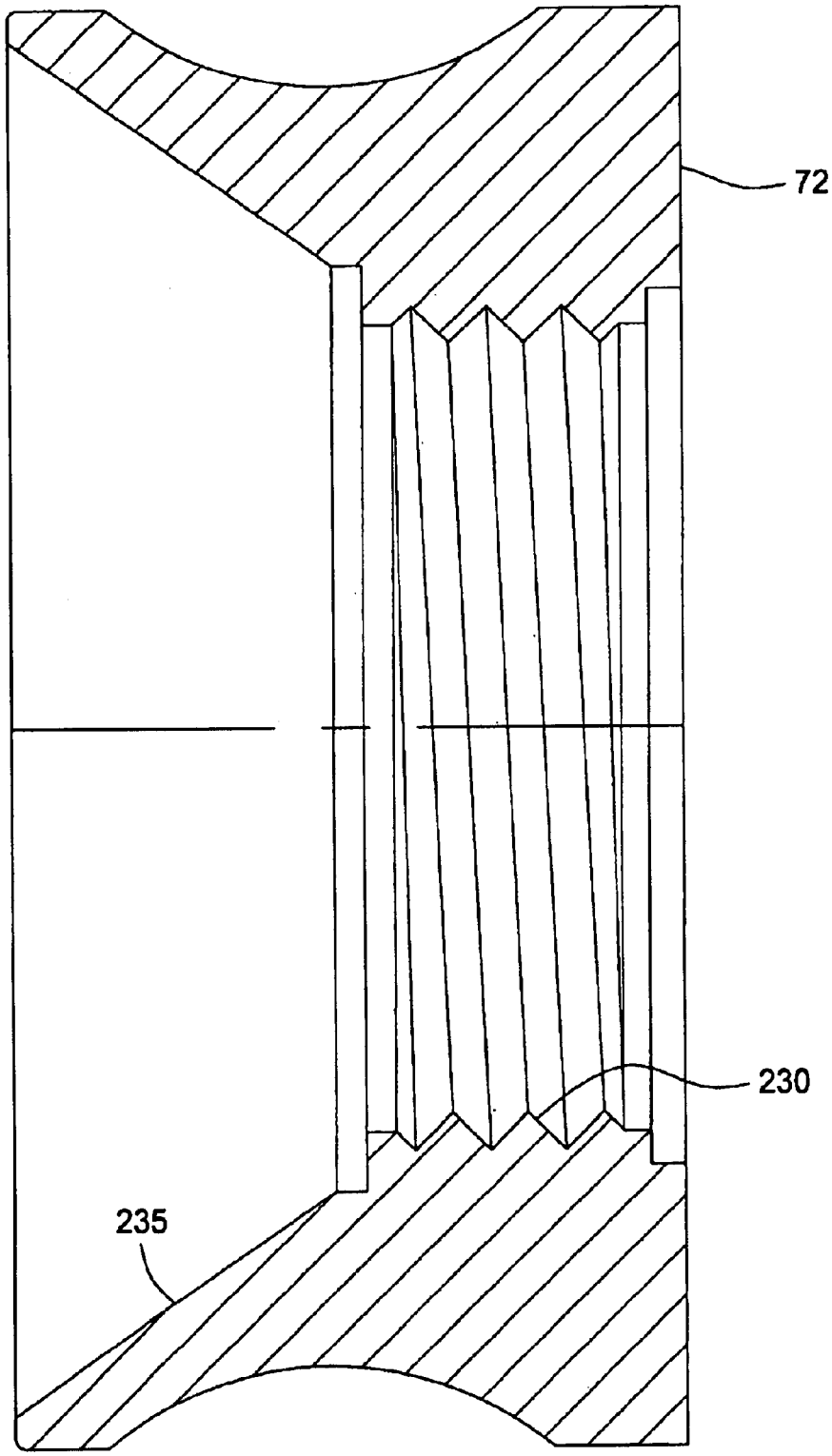
FIG. 3 is a cross-sectional view of the lower backup member of the assembly shown in FIG. 1A.

The fins 70 may optionally be supported by one or more backup members 72, 74, 76. Preferably, the backup members 72, 74, 76 are in the form of annular rings made of metal. A backup member 72, 74 may be disposed on each end of the fins 70. In one embodiment, the lower backup member 72 is disposed between the stop member 120 and the fins 70. As illustrated in FIG. 3, the lower backup member 72 has a partially threaded inner surface 230 for mating with a threaded surface 130 of the body 110. The lower backup member 72 may also have a cone-shaped inner surface 235 to complement the shape of the fins 70. The upper backup member 74 works with the lower backup member 72 to prevent axial movement of the fins 70 relative to the plug 10. The upper backup member 74 has a cone shaped interior to accommodate the plug landing bushing 60. Intermediate backup members 76 may also be disposed between each fin 70. The intermediate backup members 76 are designed to provide support between each fin 70. The backup members 72, 74, 76 allow the elastomeric fins 70 to maintain maximum contact with the inner surface of the liner 205.

In another aspect, the ball seat 30 is selectively connected to the inner surface of the plug 10 to form the plug and ball seat assembly 100 shown in FIG. 1A. An example of the ball seat 30 includes a swab cup ball seat or any applicable ball seat known to a person of ordinary skill in the art. In one embodiment, the ball seat 30 is selectively connected to the plug 10 using a shearable connection. Preferably, one or more holes 80 are formed on an outer surface of the ball seat 30 for mating with a shearable member 85. The holes 80 are formed in alignment with an annular groove 125 on the inner surface of the plug 10. The shearable member 85, which is a shearable pin in this embodiment, is at least partially disposed in both the recess groove 125 of the plug 10 and a respective hole 80 in the ball seat 10. The shearable pins 85 are designed to shear at a predetermined pressure. The number of pins 85 used to maintain the ball seat 30 in the unreleased position depends on the desired ball seat release pressure. In this manner, the ball seat 30 may be maintained in the plug 10 until the proper time for release. It must be noted that aspects of the present application also contemplate other types of shearable connections for selectively maintaining the ball seat 30 in the plug 10 as is known to a person of ordinary skill in the art The plug and ball seat assembly 100 is selectively maintained in the housing 20 using a mounting system that is actuated by the release of the ball seat 30 from the plug 10. The mounting system includes a mounting plate 90 and one or more mounting members 95. FIG. 4 illustrates a top view of a preferred embodiment of the mounting plate 90. The mounting plate 90 is in the form of an annular ring having four arcuate slots 92 formed concentric to the center of the mounting plate 90 for slidable connection with the slotted portion 115 of the body 110. Additionally, the mounting plate 90 has a threaded inner surface 97 that mates with a threaded lower portion 35 of the ball seat 30 as shown in FIG. 1A. In this manner, the mounting plate 90 is movable with the ball seat 30.

Figure 4A:
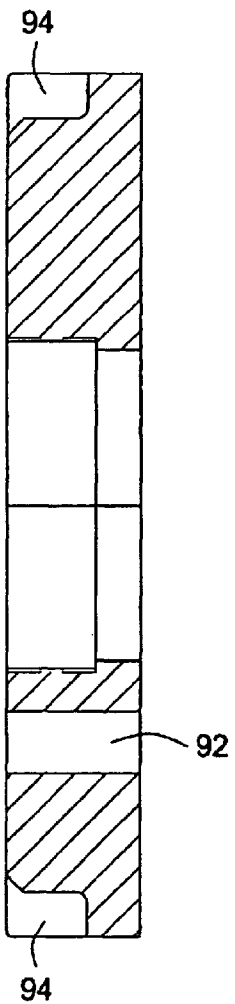
FIG. 4A is a cross-sectional view of the mounting plate of FIG. 4 along line 4A—4A.
Figure 4:
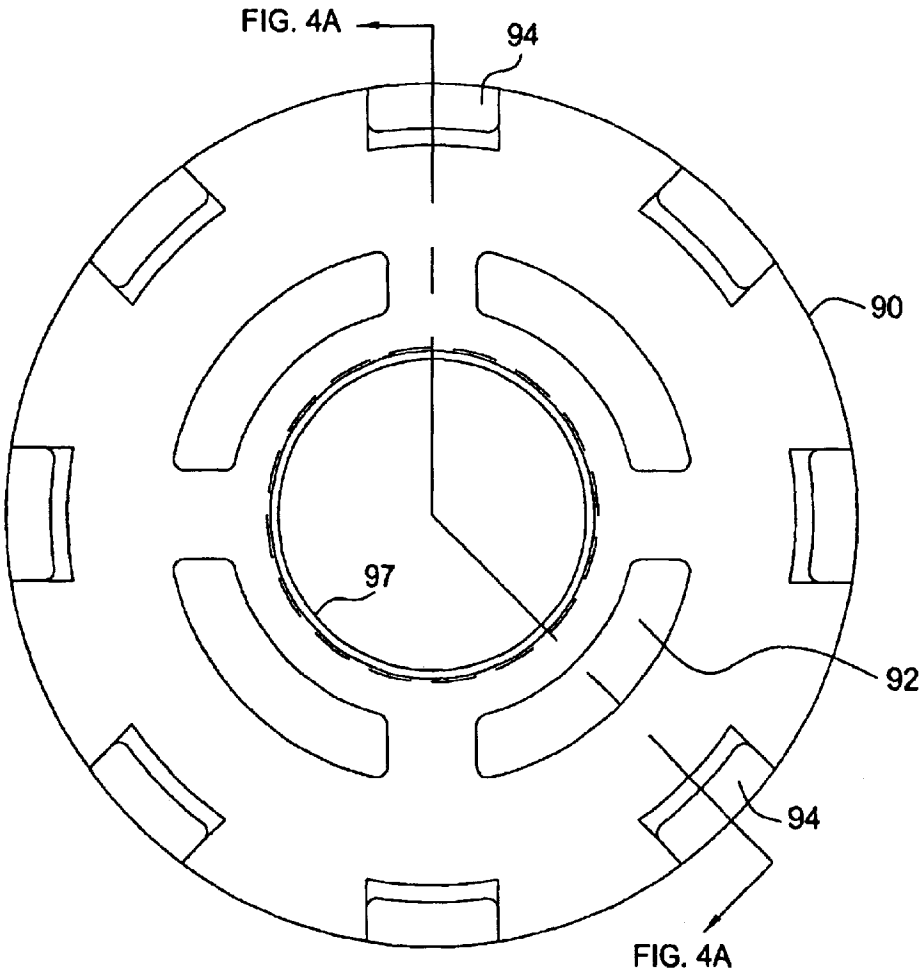
FIG. 4 is a top view of the mounting plate of the assembly shown in FIG. 1A.

A plurality of mounting supports 94 are formed on an outer surface of the mounting plate 90 for receiving a mounting member 95 as illustrated in FIGS. 1A, 4, and 4A. FIG. 4A shows a cross-sectional view of the mounting plate 90 along line 4A—4A. As shown, eight radially spaced mounting supports 94 are formed on the mounting plate 90 and designed to at least partially receive the mounting members 95. Referring to FIG. 1A, each mounting member 95 at least partially resides in the mounting support 94 and is trapped between the mounting plate 90 and the lower backup ring 72. In one embodiment, each mounting member 95 comprises a ball made of metal or some other material capable of supporting the weight of the assembly 100. Preferably, the total outer diameter of the mounting plate 90 with the mounting members 95 disposed therein is greater than an inner diameter of the housing 20. In this respect, the mounting member 95 may at least partially reside in the groove 25 of the housing 20, thereby maintaining the plug and ball seat assembly 100 in the housing 20 until it is ready to be released.

In operation, the plug and ball seat assembly 100 disposed in the housing 20 may be attached to an upper portion of a liner 205 as shown in FIG. 5A. The liner 205 may be operatively connected to a liner hanger assembly (not shown) and lowered into the wellbore (not shown) using a run-in string (not shown). The liner hanger assembly may be a hydraulically operated liner hanger assembly or any other liner hanger assembly known to a person of ordinary skill in the art. The liner 205 is lowered into the wellbore until it reaches the desired depth. For example, the liner 205 may be placed in an overlapping position with an existing casing (not shown) in the wellbore. Before its release, the plug and ball seat assembly 100 is supported in the housing 20 through the mounting plate 90 and the mounting members 95.

Figure 1B:
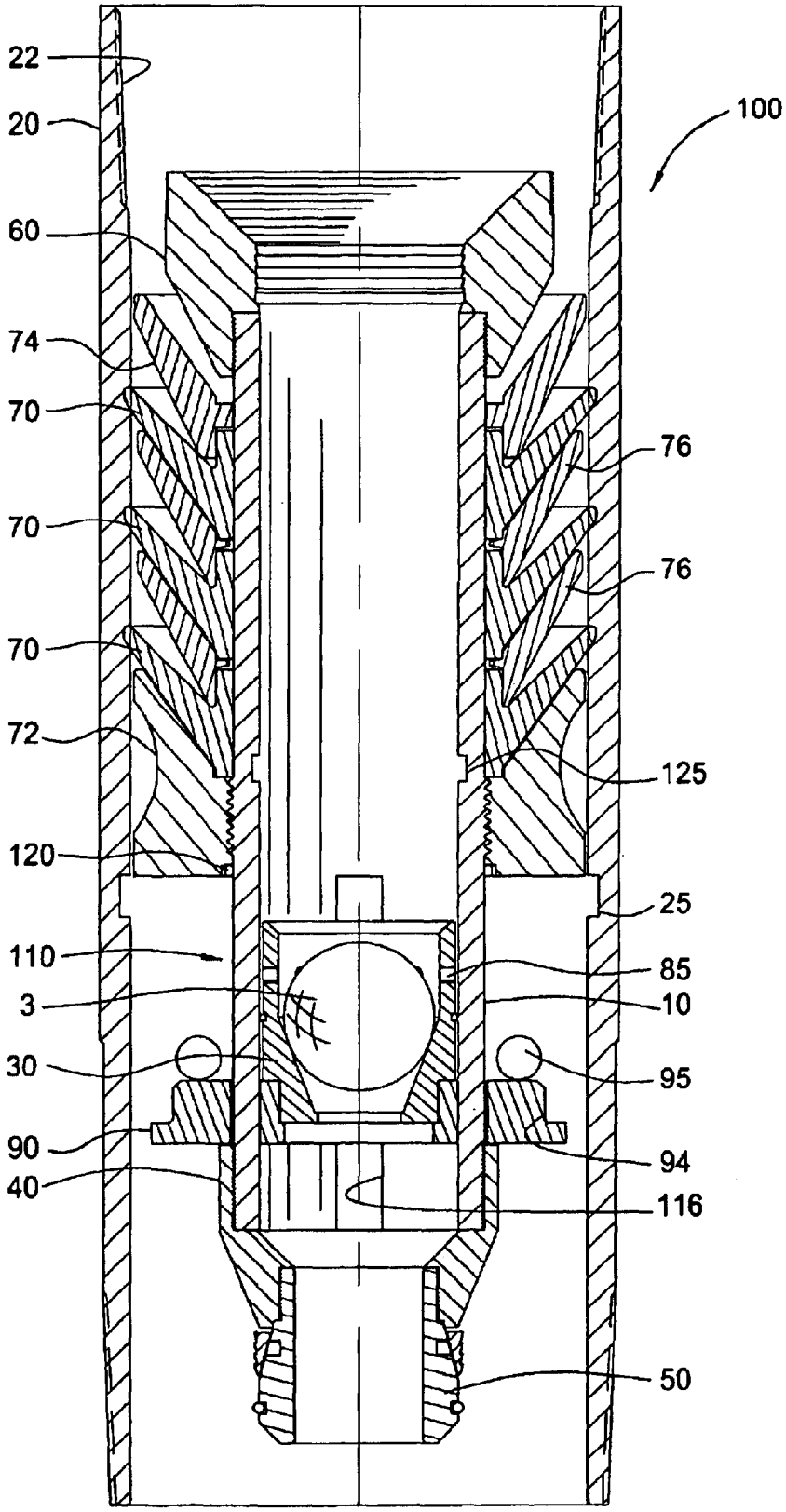
FIG. 1B shows the plug and ball seat assembly released from the housing.

When the liner 205 is ready to be hung off of the casing, a ball 3 is dropped into the wellbore. The ball 3 may travel through the drill pipe and the running tool, and land in the ball seat 30 of the assembly 100 as shown in FIGS. 1B and 5A, thereby closing off fluid communication between the wellbore below the ball seat 30 and the wellbore above the ball seat 30. Thereafter, pressure is supplied to the liner hanger assembly to set the hanger to hang the liner 205 in the casing.

After the liner 205 is hung, pressure is increased to shear the pins 85 connecting the ball seat 30 to the plug 10. When the pressure reaches the predetermined pressure necessary to shear the pins 85, the ball seat 30 detaches and travels along the interior of the plug 10 toward the nose plug 50 as shown in FIG. 1B. Because the mounting plate 90 is attached to the ball seat 30, the mounting plate 90 moves downward along with the ball seat 30. As the mounting plate 90 moves away from the lower backup ring 72, the mounting members 95 are treed from the mounting plate 90 and allowed to fall out of the groove 25 of the housing 20 and travel downward. In this manner, the plug 10 is disengaged from the housing 20 and released downhole toward the float assembly 215. As the plug 10 descends in the wellbore, the ball seat 30 and the mounting plate 90 will move toward the nose plug 50 until it contacts the nose plug 50.

Figure 5B:
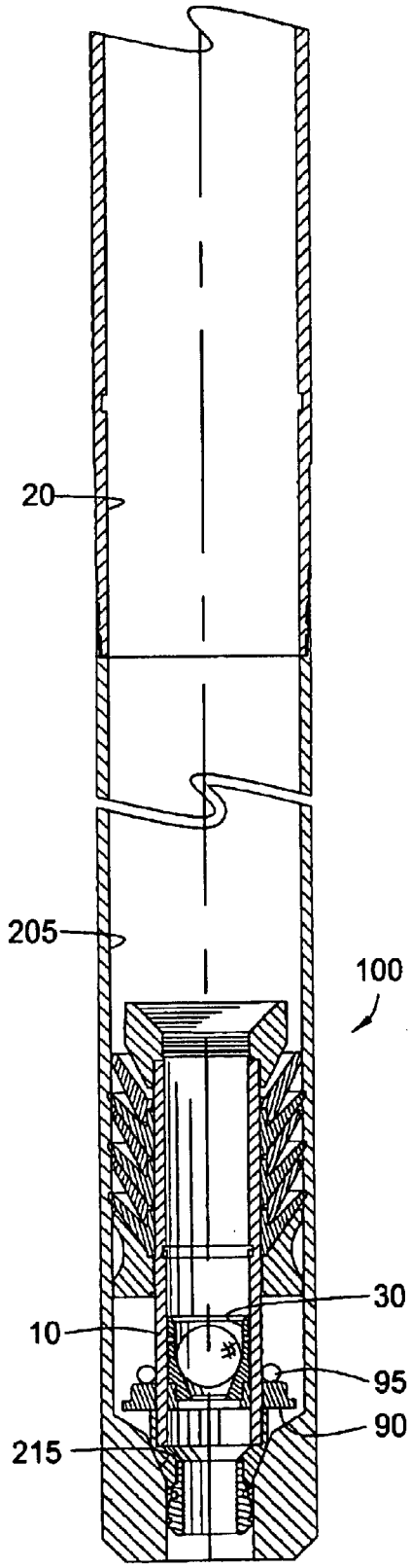
FIG. 5B is a schematic cross-sectional view of the plug and ball seat assembly landing in the float assembly.

Fluid behind the plug and ball seat assembly 100 pumps the assembly 100 along the liner 205 until it lands in the float assembly 215 disposed at the bottom of the liner 205 as shown in FIG. 5B. The float assembly 205 prevents the assembly 100 from further axial movement after landing.

As can be seen, a plug and ball seat assembly 100 has been provided. In this respect, the ball seat 30 may be located near the top of the liner 205 without being attached to any running tool. In this manner, the ball seat 30 may be positioned high enough in the liner 205 to not impact the formation with surge pressure and prevent the premature launch of the plug 10.

While the foregoing is directed to embodiments of the present invention, other and further embodiments of the invention may be devised without departing from the basic scope thereof, and the scope thereof is determined by the claims that follow. In this respect, it is within the scope of the present invention to use the plug and ball assembly 100 disclosed herein to release plugs 10 for various cleaning and fluid circulation procedures in addition to cementing operations for liners. The plug and ball seat assembly 100 of the present invention has utility in the context of subsea operations and for cementing operations of any string of casing.

What is claimed is:

1. A plug and ball seat assembly for releasing a plug disposed in a tubular, comprising:

a ball seat selectively connected to the plug, wherein the plug comprises a body and at least one fin; and a mounting system selectively connected to the tubular for maintaining the plug in the tubular, wherein disengaging the ball seat from the plug also disengages the plug from the tubular.

2. The assembly of claim 1, wherein the body comprises a tubular having a slotted portion.

3. The assembly of claim 2, wherein the mounting system comprises a mounting plate and one or more mounting members.

4. The assembly of claim 3, wherein the mounting plate includes slots for mating with the slotted portion of the plug.

5. The assembly of claim 4, wherein the mounting plate is attached to the ball seat.

6. The assembly of claim 5, wherein the plug further comprises a stop member.

7. The assembly of claim 6, wherein the one or more mounting members are at least partially disposed between the stop member and the mounting plate.

8. The assembly of claim 1, wherein the ball seat is selectively connected to the plug using a shearable connection.

9. The assembly of claim 8, wherein the shearable connection comprises a shearable member at least partially disposed in the ball seat and the plug.

10. The assembly of claim 1, wherein the mounting system comprises a mounting plate and one or more mounting members.

11. The assembly of claim 10, wherein the mounting plate is connected to the ball seat.

12. The assembly of claim 10, wherein each of the one or more mounting members is at least partially disposed within a mounting support formed on the mounting plate.

13. The assembly of claim 12, wherein each of the one or more mounting members is at least partially disposed within a receiving member formed on an inner surface of the tubular.

14. A method of releasing a plug in a tubular, comprising:

selectively connecting a ball seat to the plug, wherein the plug comprises a body and at least one fin;

selectively connecting the plug and ball seat to the tubular;

disconnecting the ball seat from the plug, whereby the ball seat may move axially relative to the plug;

detaching the plug and ball seat from the tubular; and releasing the plug.

15. The method of claim 14, wherein disconnecting the ball seat from plug causes the plug to detach from the tubular.

16. A method of circulating a fluid within a casing, comprising:

releasably attaching a plug and ball seat assembly to the casing;

selectively blocking movement of the fluid through the casing;

disengaging a shearable connection between the plug and the ball seat; and releasing the plug and ball seat assembly from the casing, thereby allowing the movement of the fluid to continue.

17. The method of claim 16, wherein the movement of the fluid if blocked by dropping a ball into the plug and ball seat assembly.

18. The method of claim 17, wherein disconnecting the plug from the ball seat causes the plug and ball seat assembly to release from the casing.

19. A plug and ball seat assembly for releasing a plug, comprising:

a ball seat selectively connected to the plug;

the plug having a body, a plurality of fins disposed on an outer portion of the body, and a stop member; and a mounting system for selectively maintaining the plug in a tubular, the mounting system having a mounting plate and one or more mounting members and is attached to the ball seat, wherein the one or more mounting members are at least partially disposed between the stop member and the mounting plate and wherein disengaging the ball seat from the plug also disengages the plug from the tubular.

20. A plug and ball seat assembly for releasing a plug, comprising:

a ball seat selectively connected to the plug; and a mounting system having a mounting plate and one or more mounting members for selectively maintaining the plug in a tubular, wherein each of the one or more mounting members is at least partially disposed within a mounting support formed on the mounting plate and at least partially disposed within a receiving member formed on an inner surface of the tubular and wherein disengaging the ball seat from the plug also disengages the plug from the tubular.

* * * * *